US010488087B2

(12) United States Patent
Beikmann

(10) Patent No.: US 10,488,087 B2
(45) Date of Patent: Nov. 26, 2019

(54) MODULATOR ASSEMBLY FOR CONDENSER

(71) Applicant: DENSO International America, Inc., Southfield, MI (US)

(72) Inventor: Aric Beikmann, Brighton, MI (US)

(73) Assignee: DENSO International America, Inc., Southfield, MI (US)

( * ) Notice: Subject to any disclaimer, the term of this patent is extended or adjusted under 35 U.S.C. 154(b) by 136 days.

(21) Appl. No.: 15/875,664

(22) Filed: Jan. 19, 2018

(65) Prior Publication Data

US 2019/0226730 A1 Jul. 25, 2019

(51) Int. Cl.
*F25B 39/04* (2006.01)
*F28D 1/00* (2006.01)

(52) U.S. Cl.
CPC ..... *F25B 39/04* (2013.01); *F28D 1/00* (2013.01); *F25B 2339/0446* (2013.01); *F25B 2500/221* (2013.01)

(58) Field of Classification Search
CPC ..... F25B 39/04; F25B 2500/221; F25B 2339/0446; F25B 49/02
See application file for complete search history.

(56) References Cited

U.S. PATENT DOCUMENTS 5,186,248 A * 2/1993 Halstead ..... B60H 1/3227 165/153
6,223,556 B1 * 5/2001 De Keuster ..... F25B 39/04 165/132
6,341,647 B1 * 1/2002 Nobuta ..... F25B 39/04 165/132
6,640,582 B2 * 11/2003 Incorvia ..... F25B 39/04 210/287
6,981,389 B2 * 1/2006 Knecht ..... F25B 43/003 62/474
7,428,825 B2 * 9/2008 Forster ..... F25B 39/04 62/474
2005/0274506 A1 * 12/2005 Bhatti ..... F28D 1/05391 165/177
2008/0006052 A1 * 1/2008 Ki ..... F25B 43/006 62/474
2010/0025028 A1 * 2/2010 Shinhama ..... F25B 39/04 165/174
2015/0233653 A1 * 8/2015 Kuhbauch ..... F28D 1/05366 165/175
2015/0377565 A1 * 12/2015 Fudala ..... B01D 35/02 137/544

FOREIGN PATENT DOCUMENTS

IN 2795DEL2013 6/2016
JP 2004232924 A 8/2004
JP 2013139998 A 7/2013

* cited by examiner

*Primary Examiner* — Emmanuel E Duke
(74) *Attorney, Agent, or Firm* — Harness, Dickey & Pierce, P.L.C.

(57) ABSTRACT

A modulator assembly for a condenser. The modulator assembly has a tube having a first end and a second end. A first connector is brazed to the first end of the tube. A second connector is threadably secured at the second end of the tube.

18 Claims, 3 Drawing Sheets

MODULATOR ASSEMBLY FOR CONDENSER

FIELD

The present disclosure relates to a modulator assembly for a condenser, the modulator assembly including a brazed-in connector and/or a threaded-in connector.

BACKGROUND

This section provides background information related to the present disclosure, which is not necessarily prior art.

Existing condensers include inlet and outlet connectors, which are brazed to one or both header tanks of the condenser. Many existing condensers also have a modulator brazed to one of the header tanks. While existing condenser assemblies are suitable for their intended use, they are subject to improvement. For example, because each brazing is a potential leak path, it would be desirable to reduce the number of brazing connections to the header tanks. The present disclosure advantageously includes a modulator assembly for a condenser that reduces the number of brazing connections to the header tanks of the condenser, thereby reducing the number of potential leak paths. The present disclosure also provides various packaging and production advantages, as one skilled in the art will appreciate.

SUMMARY

This section provides a general summary of the disclosure, and is not a comprehensive disclosure of its full scope or all of its features.

The present disclosure includes a modulator assembly for a condenser. The modulator assembly has a tube having a first end and a second end. A first connector is brazed to the first end of the tube. A second connector is threadably secured at the second end of the tube.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of select embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
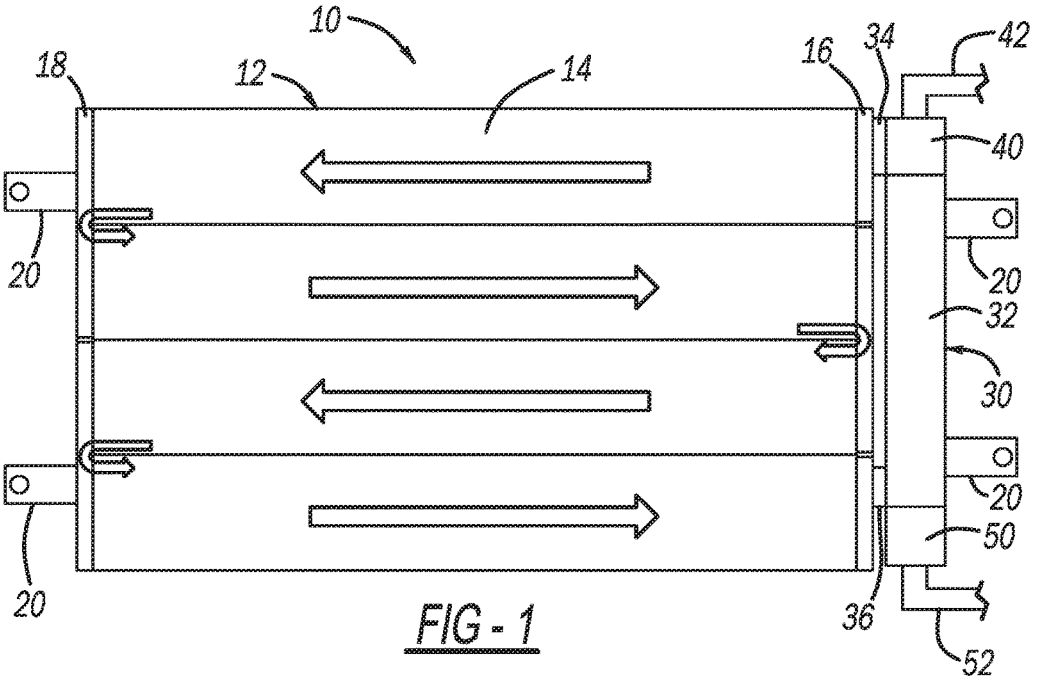
FIG. 1 illustrates an exemplary condenser and modulator in accordance with the present teachings.

With initial reference to FIG. 1, a condenser assembly in accordance with the present disclosure is illustrated at reference numeral 10. The condenser assembly 10 can be configured for use with any suitable heating, ventilation, and air conditioning (HVAC) system, such as any suitable vehicle HVAC system or non-vehicular HVAC system. The condenser assembly 10 generally includes a condenser 12 and a modulator assembly 30.

The condenser 12 generally includes a core 14 of refrigerant conduits, which extend between a first header tank 16 and a second header tank 18. The condenser assembly 10 may include one or more mounting brackets 20 for mounting the condenser assembly 10 at any suitable location. In the example of FIG. 1, mounting brackets 20 are mounted to the modulator assembly 30 and the second header tank 18. The mounting brackets 20 may be secured in any suitable manner, such as by brazing.

The modulator assembly 30 includes a tube 32. The tube 32 can be made of any suitable material, such as aluminum. The tube 32 is secured to the first header tank 16 by brazing at tank mating portions 34 and 36.

The modulator assembly 30 includes an inlet connector 40, which is connected to any suitable inlet conduit 42. Refrigerant flows through the inlet conduit 42 to the inlet connector 40. From the inlet connector 40, the refrigerant flows into the condenser 12 through an opening of the first header tank 16. At the condenser 12, high pressure gas refrigerant condenses as the refrigerant flows through the core 14. From the core 14, the refrigerant flows out of an opening of the first header tank 16, and back to the modulator assembly 30 by way of the tank mating portion 36 and an outlet connector assembly 50. Liquid refrigerant flows out of the modulator assembly 30 through an outlet conduit 52, and any remaining gaseous refrigerant continues to condense within the modulator assembly 30. After the gaseous refrigerant condenses into liquid refrigerant, it flows out through the outlet conduit 52. Thus the condenser assembly 10 advantageously radiates heat out of the refrigerant and the HVAC system generally. The condenser assembly 10 can be configured as a three-pass condenser assembly, a one-pass condenser assembly, or any other suitable condenser assembly having any suitable number of passes, such as, but not limited to, passes of any odd number increments.

Figure 2:
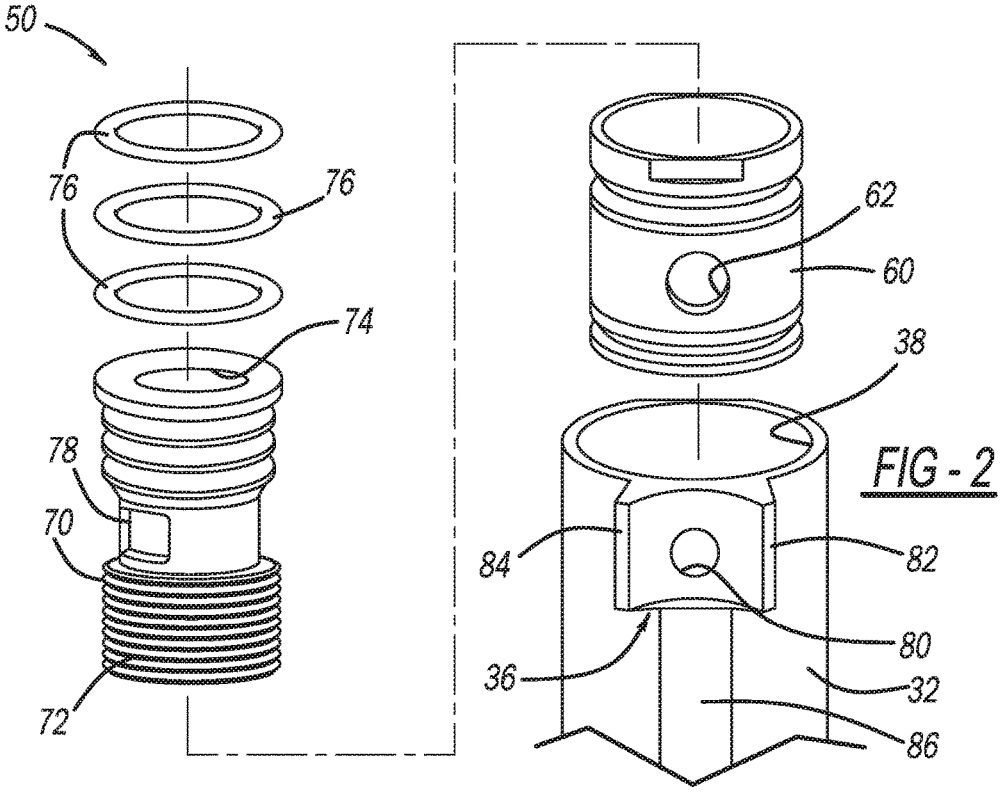
FIG. 2 is a exploded view of an outlet end of the modulator of FIG. 1.

With continued reference to FIG. 1, and additional reference to FIG. 2, the outlet connector assembly 50 will now be described in additional detail. The outlet connector assembly 50 may include a block 60, which is secured within an outlet end 38 of the tube 32. The block 60 is secured within the outlet end 38 in any suitable manner, such as by brazing. The block 60 defines an opening 62, which is aligned with an opening 80 of the tube 32. The opening 80 is aligned with an outlet opening of the tank 16. In some applications, the outlet end 38 of the tube 32 is threaded. If the outlet end 38 is threaded, the outlet connector 70 described below may be threadably connected directly to the tube 32, thus eliminating any need for the block 60.

The outlet connector assembly 50 further includes the outlet connector 70. The outlet connector 70 has a plurality of threads 72, which are configured to cooperate with internal threads of the block 60. The outlet connector 70 defines an outlet 74, to which the outlet conduit 52 can be connected to. To provide a seal between the outlet connector 70 and the outlet conduit 52, one or more seals, such as washers 76, can be arranged proximate to the outlet 74. The outlet connector 70 defines an opening 78, which is aligned with the opening 62 of the block 60 when the outlet connector 70 is threaded into cooperation with the block 60. The block 60 and the outlet connector 70 can each be made of any suitable material, such as aluminum.

The threaded connection between the outlet connector 70 and the block 60 advantageously allows the outlet connector 70 to be removably attached to the block 60. Thus after the block 60 is braised to the tube 32, the outlet connector 70 may be threadably coupled to, and decoupled from, the block 60 in order to allow a suitable drying agent, such as a desiccant (e.g., desiccant beads) to be added to, or removed from, the modulator assembly 30. The desiccant absorbs moisture to prevent it from circulating throughout the HVAC system.

The tank mating portion 36 is at the opening 80, and includes a first leg 82 and a second leg 84 on opposite sides of the opening 80. The first and second legs 82 and 84 each extend outward, and are generally curved to match an outer radii of the first header tank 16 so that the first and second legs 82 and 84 closely abut the first header tank 16. A planar surface 86 of the tube 32 extends between the tank mating portion 36 and the tank mating portion 34, and is shaped to abut a generally planar portion of the first header tank 16. The tank mating portion 34 is the same as, or substantially similar to, the tank making portion 36, and thus the illustration and description of the tank mating portion 36 is sufficient to describe the tank mating portion 34. With regards to FIG. 3A, the first and second legs of the tank mating portion 34 are illustrated at reference numbers 82' and 84'.

Figure 3A:
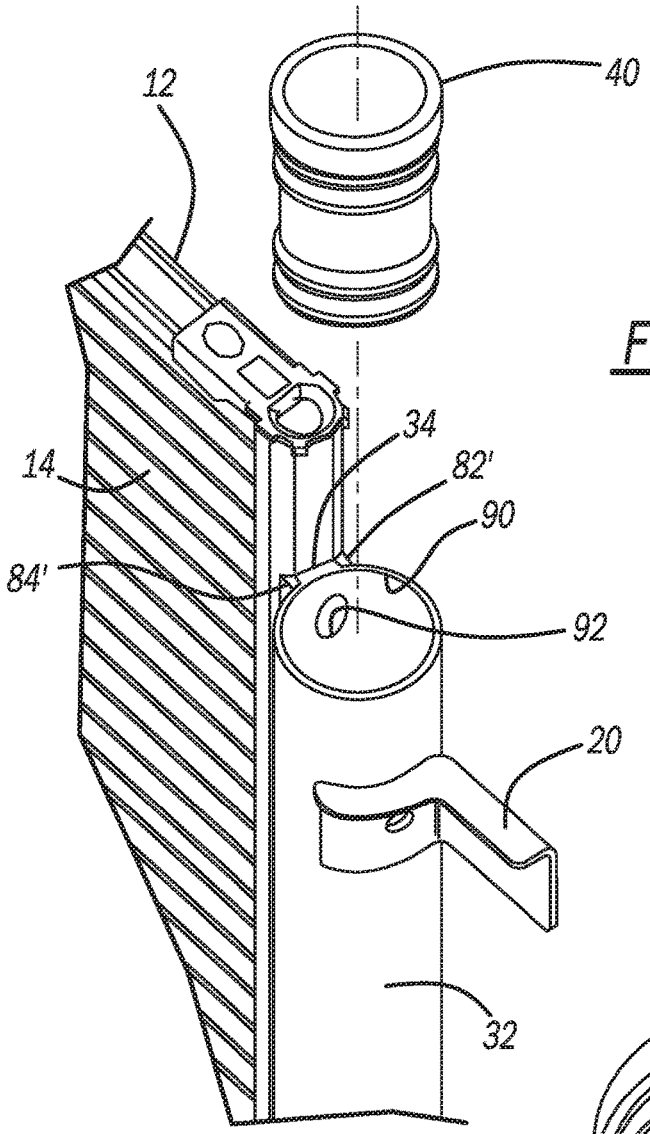
FIG. 3A is an exploded view of an inlet end of the modulator of FIG. 1.
Figure 3B:
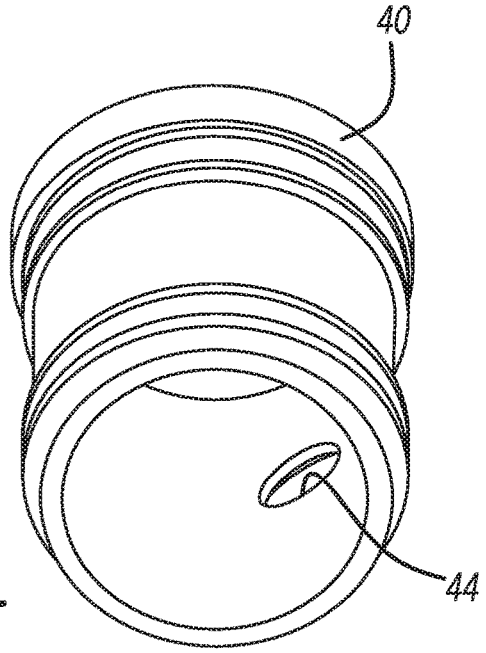
FIG. 3B is a perspective view of an inlet connector at the inlet end of the modulator.
Figure 4:
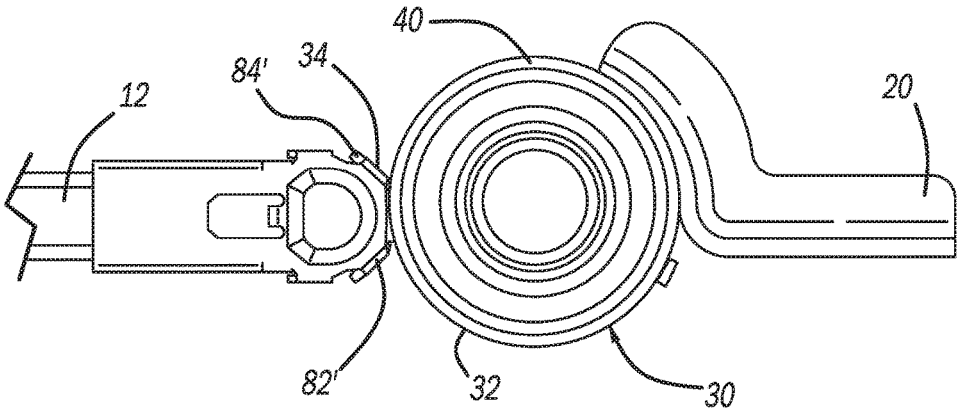
FIG. 4 is a top view of the modulator of FIG. 1 connected to a header tank of the condenser of FIG. 1.

With additional reference to FIGS. 3A, 3B, and 4, the inlet connector 40 is illustrated in additional detail. The inlet connector 40 defines an opening 44, which is aligned with an opening 92 of the tube 32 at the inlet end 90. The opening 92 is aligned with an inlet opening defined by the first header tank 16. The inlet connector 40 is secured within the inlet end 90 of the tube 32 in any suitable manner, such as by brazing. Although the inlet connector 40 is described as being brazed at the inlet end 90, in other applications the inlet connector 40 may be brazed within the outlet end 38, and the outlet connector assembly 50 may be arranged at the inlet end 90. In still other applications, both the inlet end 90 and the outlet end 38 may include outlet connector assemblies.

Thus the present disclosure advantageously provides for a modulator assembly 30 as a single sub-assembly having both an inlet connector 40 and an outlet connector assembly 50, which eliminates any need for separate inlet and outlet connectors to be brazed to the tanks 16/18 of the condenser 12. Reducing the number of brazings to the tanks 16/18 advantageously reduces potential leak paths. Providing the modulator assembly 30 as a single subassembly also provides various packaging and production advantages, as one skilled in the art will appreciate. For example, the present disclosure permits a more narrow condenser profile, increased design flexibility, and has few features that may potentially obstruct use of side seals. One skilled in the art will appreciate that the present disclosure provides numerous additional advantages and unexpected results over the art.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A modulator assembly for a condenser, the modulator assembly comprising:

a tube having a first end and a second end, the tube defines an inlet opening proximate to the first end and an outlet opening proximate to the second end, with the tube connected to a tank of the condenser the inlet opening aligns with a tank inlet and the outlet opening aligns with a tank outlet;

a first connector brazed to the first end of the tube, the first connector is configured to direct refrigerant through the inlet opening and the tank inlet into the tank of the condenser; and a second connector threadably secured at the second end of the tube, the second connector is configured to direct refrigerant out from within the tank and out of the modulator.

2. The modulator assembly of claim 1, wherein the second connector is threadably coupled to threads at the second end of the tube.

3. The modulator assembly of claim 1, further comprising a connector assembly at the second end of the tube, the connector assembly including a block brazed to the second end and the second connector threaded into cooperation with the block.

4. The modulator assembly of claim 3, wherein the tube is extruded aluminum, the first connector includes aluminum, the second connector includes aluminum, and the block includes aluminum.

5. The modulator assembly of claim 3, wherein the block includes internal threads and the second connector includes external threads configured to mate with the internal threads of the block.

6. The modulator assembly of claim 1, wherein the first connector is an inlet connector, and the second connector is an outlet connector.

7. The modulator assembly of claim 1, wherein the first connector is an outlet connector, and the second connector is an inlet connector.

8. The modulator assembly of claim 1, wherein the tube includes a first tank mating portion proximate to the first end, the first tank mating portion including: a planar surface at an exterior of the tube surrounding the inlet opening; and legs on opposite sides of the planar surface, the legs are curved to match an outer radii of the tank such that the legs mate with the tank.

9. The modulator assembly of claim 1, wherein the tube includes a second tank mating portion proximate to the second end, the second tank mating portion including: a planar surface at an exterior of the tube surrounding the outlet opening; and legs on opposite sides of the planar surface, the legs are curved to match an outer radii of the tank such that the legs mate with the tank.

10. The modulator assembly of claim 1, wherein the tube is brazed to the tank at the inlet opening and at the outlet opening.

11. The modulator assembly of claim 1, further comprising at least one mounting bracket brazed to the tube, and at least one mounting bracket brazed to a header tank at an end of the condenser opposite to the modulator.

12. A condenser assembly comprising:

a condenser including a core, a first tank at a first end of the core, and a second tank at a second end of the core;

a modulator assembly including a tube connected to the first tank such that an outlet opening defined by the tube is aligned with a tank inlet of the first tank, and an inlet opening defined by the tube is aligned with a tank outlet of the first tank;

an inlet connector brazed to a first end of the tube; and an outlet connector assembly at a second end of the tube, the outlet connector assembly including a block brazed to the second end and a second connector threaded into cooperation with the block.

13. The condenser assembly of claim 12, wherein the tube is brazed to the first tank at a first interface between the outlet opening and the tank inlet, and at a second interface between the inlet opening and the tank outlet.

14. The condenser assembly of claim 12, wherein the tube is extruded aluminum, the inlet connector includes aluminum, the outlet connector includes aluminum, and the block includes aluminum.

15. The condenser assembly of claim 12, wherein the tube includes a first tank mating portion proximate to the first end, the first tank mating portion including: a planar surface at an exterior of the tube surrounding the inlet opening; and legs on opposite sides of the planar surface, the legs are curved to match an outer radii of the tank such that the legs mate with the tank.

16. The condenser assembly of claim 12, wherein the tube includes a second tank mating portion proximate to the second end, the second tank mating portion including: a planar surface at an exterior of the tube surrounding the outlet opening; and legs on opposite sides of the planar surface, the legs are curved to match an outer radii of the tank.

17. The condenser assembly of claim 12, wherein the block includes internal threads and the second connector includes external threads configured to mate with the internal threads of the block to removably connect the second connector to the block and allow insertion of a desiccant within the tube.

18. The condenser assembly of claim 12, further comprising at least one mounting bracket brazed to the tube, and at least one mounting bracket brazed to a header tank at an end of the condenser opposite to the modulator.

* * * * *